US006440290B1

(12) United States Patent
Vega et al.

(10) Patent No.: US 6,440,290 B1
(45) Date of Patent: Aug. 27, 2002

(54) METHOD FOR SURFACE TREATING ALUMINUM PRODUCTS

(75) Inventors: Luis F. Vega, Cheswick; Kevin M. Robare, New Kensington, both of PA (US); Mark A. Holtz, Chagrin Falls; John R. Grassi, Cleveland, both of OH (US); Neal R. Dando, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 16 days.

(21) Appl. No.: 09/729,567

(22) Filed: Dec. 4, 2000

Related U.S. Application Data

(63) Continuation-in-part of application No. 09/384,526, filed on Aug. 27, 1999, now abandoned.
(60) Provisional application No. 60/098,320, filed on Aug. 28, 1998.

(51) Int. Cl.[7] ..... C25D 11/24; C25D 5/44; C25D 11/18
(52) U.S. Cl. ..... 205/201; 205/213; 205/229
(58) Field of Search ..... 205/172, 201, 205/213, 229

(56) References Cited

U.S. PATENT DOCUMENTS

| | | | | |
|---|---|---|---|---|
| 3,971,873 A | | 7/1976 | Price | 428/463 |
| 4,440,606 A | | 4/1984 | Powers et al. | 204/33 |
| 4,601,796 A | | 7/1986 | Powers et al. | 204/33 |
| 4,793,903 A | | 12/1988 | Holmquist et al. | 204/33 |
| 5,217,600 A | | 6/1993 | Le et al. | 205/328 |
| 5,290,424 A | * | 3/1994 | Mozelewski et al. | 205/116 |
| 5,486,283 A | | 1/1996 | Mnich | 205/174 |
| 5,538,600 A | | 7/1996 | Schultz et al. | 428/31 |
| 5,554,231 A | | 9/1996 | Bibber | 148/272 |
| 5,587,209 A | | 12/1996 | Soga et al. | 427/503 |
| 5,643,434 A | | 7/1997 | Benmalek et al. | 205/109 |
| 5,646,240 A | | 7/1997 | Oishi et al. | 528/403 |
| 5,693,710 A | | 12/1997 | Srinivasan et al. | 525/63 |

FOREIGN PATENT DOCUMENTS

| | | | | |
|---|---|---|---|---|
| EP | 0816875 | | 7/1998 | G02B/5/08 |
| JP | 63153296 | | 6/1988 | C25D/11/18 |
| JP | 63176145 | | 7/1988 | B32B/15/08 |
| JP | 1030749 | | 2/1989 | B32B/15/08 |
| JP | 8-120490 | * | 5/1996 | |

OTHER PUBLICATIONS

Lampman Article, "Surface Engineering of Nonferrous Metals", pp. 788–795, 1994, no month available.

* cited by examiner

*Primary Examiner*—Edna Wong
(74) *Attorney, Agent, or Firm*—Gary P. Topolosky

(57) ABSTRACT

There is disclosed a method for surface treating aluminum products, especially vehicle wheels, to improve their brightness. The method comprises: (a) applying a chemical brightening composition to these products; (b) deoxidizing the surface of these wheel products in a nitric acid-based bath; (c) forming a porous oxide on that with an electrolytic bath containing phosphoric acid; and (d) applying, preferably spraying, a siloxane-based film to that porous oxide. In many instances, intermediate rinsing substeps are performed between these respective main steps.

42 Claims, 2 Drawing Sheets

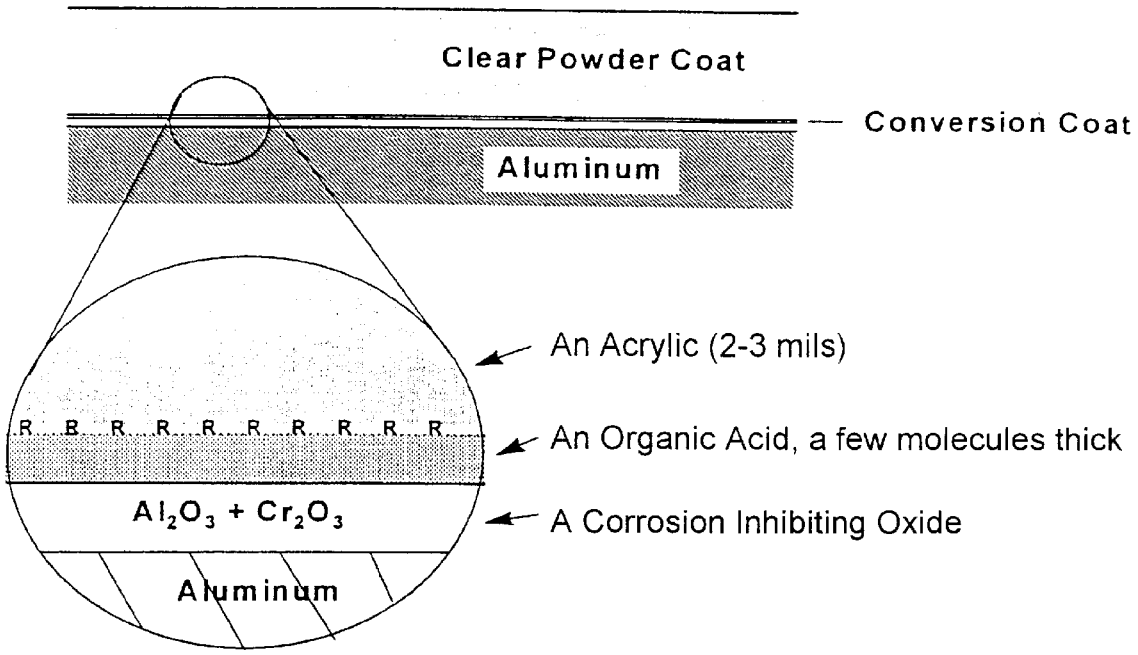
Figure 2a – Prior Art Clear Coat
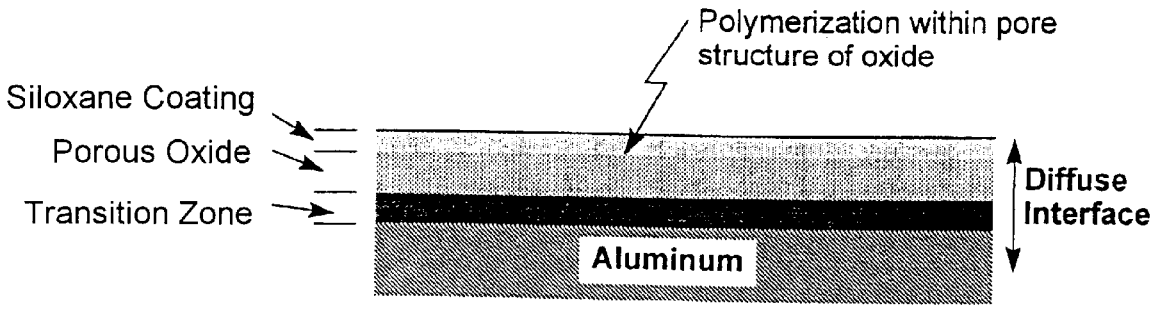
Figure 2b – The Invention

METHOD FOR SURFACE TREATING ALUMINUM PRODUCTS

CROSS REFERENCE TO RELATED APPLICATIONS

This application is a continuation-in-part of application Ser. No. 09/384,526, filed on Aug. 27, 1999, now abandoned, which claimed the benefit of U.S. Provisional Application Serial No. 60/098,320, filed on Aug. 28, 1998, both disclosures of which are fully incorporated by reference herein.

FIELD OF THE INVENTION

This invention pertains to the field of methods for cleaning and surface treating aluminum products to improve their brightness. More particularly, the invention pertains to an improved, more efficient method for surface treating aluminum wheel products made by forging, casting and/or joining practices. Such wheels are suitable for automobiles, light trucks, heavy duty trucks and buses. This invention may also be used to surface treat aerospace wheels and other aerospace components.

BACKGROUND OF THE INVENTION

Present surface treatments for bright aluminum products involve a plurality of separate steps including: cleaning, deoxidizing, chemical conversion and painting. Some of the foregoing process steps typically incorporate surface active agents and/or corrosion inhibitors. The final painting step for many aluminum products is a polymeric clear coat applied in either a liquid or powder form. All these processes rely on the availability of bright aluminum surfaces for starting. Part of the overall success of these surface treatments hinges on minimizing initial brightness degradation during application of the known chemical treatments described in more detail hereafter.

Disadvantages with such prior art processes include:

1. They required a starting bright aluminum surface. The processes did not induce any brightness themselves.
2. The chemical treatment (i.e. cleaning, deoxidizing and chemical conversion) and painting steps typically reduced the brightness of these aluminum surfaces. That, in turn, detrimentally impacted the initial properties of aluminum products made thereby.
3. Many chemical treatment and painting processes were applied to enhance: (a) the adhesion of subsequent coatings to these aluminum products; and (b) the corrosion resistance performance thereof. For any given product, a compromise had to be reached between greater brightness and greater durability.
4. From a manufacturing standpoint, past processes involved a large number of steps requiring relatively high levels of employee involvement to assure consistency and quality. That translates into high operating and production costs.
5. While maximum corrosion resistance may be achieved with hexavalent chromium, that component should be avoided because of its detrimental environmental and health risks.

Numerous processes for cleaning, etching, coating and/or surface treating aluminum products are known. They include: U.S. Pat. Nos. 4,440,606, 4,601,796, 4,793,903, 5,290,424, 5,486,283, 5,538,600, 5,554,231, 5,587,209, 5,643,434 and 5,693,710.

In U.S. Pat. No. 5,290,424, the disclosure of which is fully incorporated by reference herein, reflectivity of a particular product, decorative lighting sheet made from 5000 or 6000 Series aluminum alloys, was improved. In the process of that patent, a flexible coating was applied to that lighting sheet product. The present invention, by contrast, is not limited to just sheet product. It can also be used to surface treat aluminum forgings and castings, especially those made from Al-Mg alloys, Al-Mg-Si alloys, Al-Si-Mg alloys and/or copper-containing variants of the latter two alloys. Furthermore, the desired end result of THIS inventive method is a coating that is brittle and hard to scratch (abrasion resistant), for greater optical clarity (including brightness and corrosion resistance), unlike the focus of the more flexible coating patent described above.

SUMMARY OF THE INVENTION

The present invention imparts brightness to the surface of aluminum products, especially vehicle wheels, while improving the adhesion, soil resistance and corrosion resistance performance of such products. This invention accomplishes the foregoing property attributes through a manufacturing sequence that involves 25% fewer steps thereby reducing overall production costs. The invention combines two of the more costly known surface treatment steps, those of surface brightening and cleaning, into one step. At the same time, the method of this invention employs more user friendly components that pose no immediate or long term risks to operators or the environment. Finally, because of the chemical nature of this process, resulting end products exhibit a higher abrasion resistance.

The new method of this invention consists of:

Main Step 1. A single chemical treatment, the composition and operating parameters of which are adjusted depending on whether the preferred products to be treated are made from an Al-Mg, Al-Mg-Si or an Al-Si-Mg alloy. This chemical treatment step imparts brightness to the aluminum being treated while yielding a chemically clean outer surface ready for subsequent processing. This step replaces previous multi-step buffing and chemical cleaning operations. On a preferred basis, this chemical brightening step uses an electrolyte with a nitric acid content between about 0.05 to 2.7% by weight. It has been observed that beyond 2.7 wt % nitric acid, a desired level of brightness for Al-Mg-Si-Cu alloys cannot be achieved. On a preferred basis, the electrolyte for this step is phosphoric acid-based, alone or in combination with some sulfuric acid added thereto, and a balance of water.

Main Step 2. The second main step is to deoxidize the surface layer of said aluminum product by exposure to a bath containing nitric acid, preferably in a 1:1 dilution from concentrated. This necessary step "prep's" the surface for the oxide modification and siloxane coating steps that follow.

Main Step 3. The third main step of this invention is a surface oxide modification designed to induce porosity in the surface's outer oxide film layer. The chemical and physical properties resulting from this modification will have no detrimental effect on end product (or substrate) brightness. Like main step 1, the particulars of this oxide modification step can be chemically adjusted for Al-Mg-Si versus Al-Si-Mg alloys using an oxidizing environment induced by gas or liquid in conjunction with an electromotive potential. Surface chemistry and topography of this oxide film are critical to maintaining image clarity and adhesion of a subsequently applied polymeric coating. One preferred surface chemistry for this step consists of a mixture of aluminum oxide and aluminum phosphate with crosslinked pore depths ranging from about 0. 1 to 0.1 micrometers, more preferably less than about 0.05 micrometers.

Main Step 4. Fourthly, an abrasion resistant , siloxane-based layer is applied to the aluminum product, said layer reacting with the underlying porous oxide film, from above step 3, to form a chemically and physically stable bond therewith. Preferably, this siloxane coating is sprayed onto the substrate using conventional techniques in which air content of the sprayed mixture is minimized (or kept close to zero). To optimize transfer onto the aluminum part viscosity and volatility of this applied liquid coating may be adjusted with minor amounts of butanol being added thereto.

The foregoing method steps of this invention eliminate filiform corrosion while maintaining an initial brightness of the aluminum product to which they are applied. In some instances, the invention also imparts brightness to the product while yielding a chemically clean surface in fewer steps thereby reducing overall production costs. Finally, this invention imparts some degree of abrasion resistance, a major requirement for various aluminum products such as vehicle wheels made by forging, casting or other known or subsequently developed manufacturing practices. It accomplishes all of the foregoing without the use of environmentally risky or health threatening components.

BRIEF DESCRIPTION OF THE DRAWINGS

Further features, objectives and advantages of this invention will be made clearer from the following detailed description of preferred embodiments made with reference to the accompanying drawings in which:

FIGS. 2*a* and 2*b* are schematic, side view drawings depicting the aluminum alloy surfaces of a conventional clear coated product (FIG. 2*a*) versus an enlarged side view layering from an aluminum product treated according to this invention (FIG. 2*b*).

DETAILED DESCRIPTION OF PREFERRED EMBODIMENTS

Figure 1:
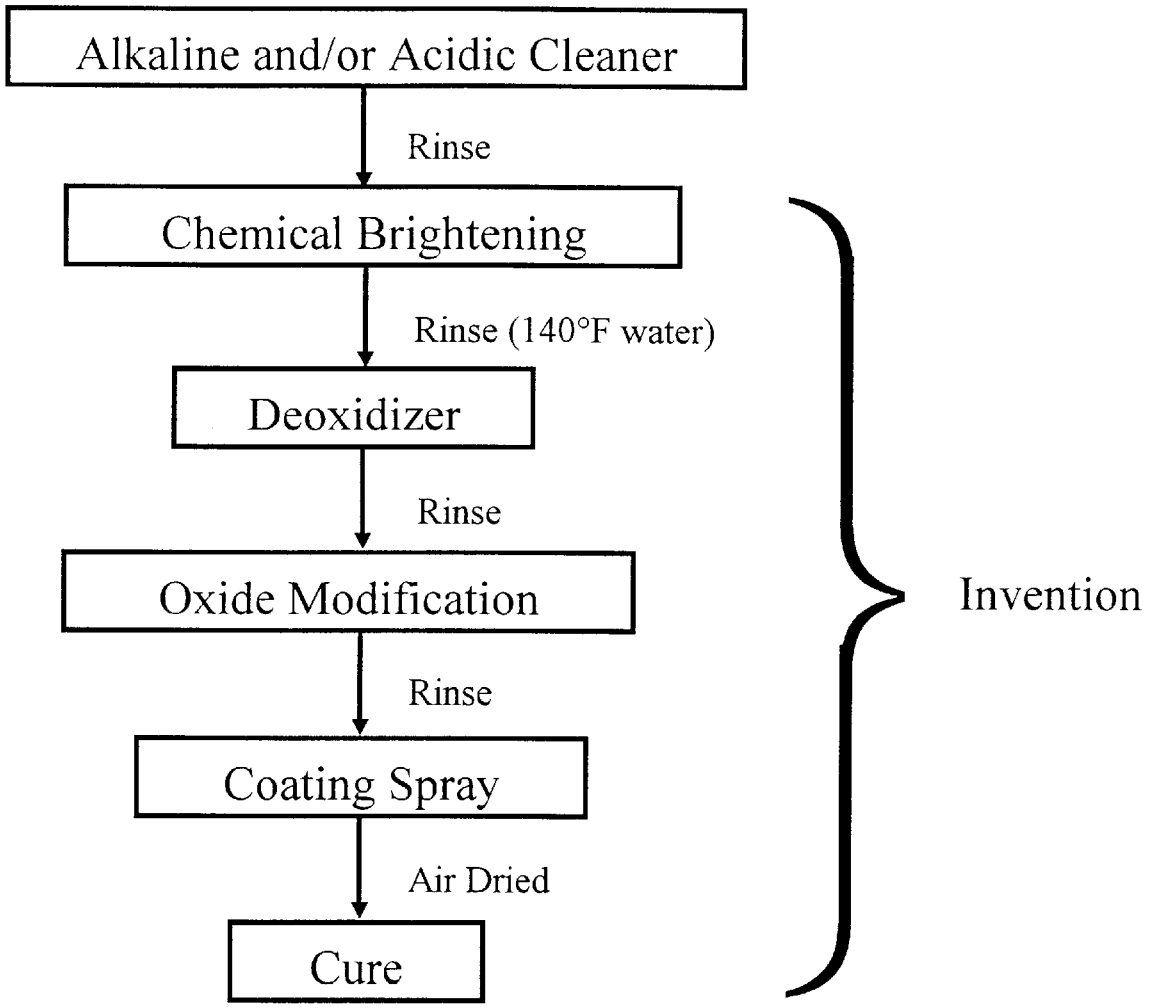
FIG. 1 is a flowchart depicting the detailed main steps, and related substeps comprising one preferred treatment method according to this invention, said steps having occurred after the typical cleaning (alkaline and/or acidic) and rinse of aluminum products.

For any description of preferred alloy compositions and/or method treatment components herein, all references are to percentages by weight percent (wt. %) unless otherwise indicated. Also, when referring to any numerical range of values herein, such ranges are understood to include each and every number and/or fraction between the stated range minimum and maximum. A magnesium content range of about 0.8–1.2 wt %, for example, would expressly include all intermediate values of about 0.81, 0.82, 0.83 and 0.9%, all the way up to and including 1.17, 1.18 and 1.19% Mg. The same applies to every other elemental and/or operational range set forth below.

When referring to aluminum alloys throughout, terms such as 5000 and 6000Series alloys, for example, are made with reference to Aluminum Association standards, the disclosures of which are fully incorporated by reference herein.

Prior to this invention, known practices for cleaning and coating a bright aluminum wheel product typically included the following individualized steps (or distinct activities): 1. A Multi-step Buff; 2. Clean; 3. Rinse; 4. Deoxidize; 5. Rinse; 6. Chemical Conversion; 7. Rinse; 8. Seal; 9. Rinse; 10. Oven Dry; 11. Powder Spray; and 12. Oven Cure. By contrast, the comparative stages of this invention, for the same wheel product, include: 1. Brightening; 2. Rinse; 3. Deoxidize; 4. Rinse; 5. Oxide Modification; 6. Rinse; 7. Dry; 8. Silicate; and 9. Cure. Through 25% fewer method steps, this invention manages to achieve better brightness, corrosion resistance and, for the first time, some enhanced abrasion resistance.

Method Step Particulars

Main step 1: Preferred chemical brightening conditions for this step are phosphoric acid-based with a specific gravity of at least about 1.65, when measured at 80° F. More preferably, specific gravities for this first main method step should range between about 1.69 and 1.73 at the aforesaid temperature. The nitric acid additive for such chemical brightening should be adjusted to minimize a dissolution of constituent and dispersoid phases on certain Al-Mg-Si-Cu alloy products, especially 6000 Series forgings. Such nitric acid concentrations dictate the uniformity of localized chemical attacks between $Mg_2Si$ and matrix phases on these 6000 Series Al alloys. As a result, end product brightness is positively affected in both the process electrolyte as well as during transfer from process electrolyte to the first rinsing substep. On a preferred basis, the nitric acid concentrations of main method step 1 should be about 2.7 wt. % or less, with more preferred additions of $HNO_3$ to that bath ranging between about 1.2 and 2.2 wt. %.

For optimum brightening, the surface treatment method of this invention should be practiced on 6000 Series aluminum alloys whose iron concentrations are kept below about 0.35% in order to avoid preferential dissolution of Al-Fe-Si constituent phases. More preferably, the Fe content of these alloys should be kept below about 0.15 wt % iron. At the aforementioned specific gravities, dissolved aluminum ion concentrations in these chemical brightening baths should not exceed about 35 g/liter. The copper ion concentrations therein should not exceed about 150 ppm.

Main step 2: A chemically brightened product is next subjected to purposeful deoxidation. One preferred deoxidizer suitable for wheel products made from 5000 or 6000 Series aluminum alloys is a nitric acid-based bath, though it is to be understood that still other known or subsequently developed deoxidizing compositions may be substituted therefor. For the nitric acid bath, a 1:1 dilution from concentrate has worked satisfactorily.

After chemical brightening, remaining concentrations of Cu should be removed from the product surface to extend its overall durability. One means for accomplishing this is to adjust the nitric acid levels above so that Cu concentrations on the alloy surface does not exceed about 0.3 wt %.

Main step 3: Subsequent to deoxidation, an oxide modification step is performed that is intended to produce an aluminum phosphate-film with the morphological and chemical characteristics necessary to accept bonding with an inorganic polymeric silicate coating. This oxide modification step should deposit a thickness coating of about 1000 angstroms or less, more preferably between about 75 and 200 angstroms thick. If applied electrochemically, this can be carried out in a bath containing about 2 to 15% by volume phosphoric acid.

Main step 4: The resultant properties of aluminum surfaces treated by to this invention are dependent on the uniformity, smoothness and adhesion strength of the final siloxane film layer deposited thereon. Siloxane-based chemistries are applied to the oxide-modified layers from Step 3 above. Both initial and long term durability of such treated products depend on the proper surface activation of these metals, followed by a siloxane-based polymerization. Abrasion resistance of the resultant product is determined by the relative degree of crosslinking for the siloxane chemicals being used, i.e. the higher their crosslinking abilities, the lower the resultant film flexibility will be. On the other hand, lower levels of siloxane crosslinking will increase the availability of functional groups to bond with modified, underlying Al surfaces thereby enhancing the initial adhesion strengths. Under the latter conditions, however, coating thicknesses will increase and abrasion resistance decreases leading to lower clarity and durability properties, respectively.

Overall, it is preferred that a hard siloxane chemistry be used with aluminum vehicle wheels made from 6000 Series alloys. Suitable siloxane compositions for use in main step 4 include those sold commercially by SDC Coatings Inc. under their Silvue® brand. Other suitable manufacturers of siloxane coatings include Ameron International Inc., and PPG Industries, Inc. It is preferred that such product polymerizations occur at ambient pressure for minimalizing the impact, if any, to metal surface microstructure.

For any given aluminum alloy composition and product form, the compatibility of main step 3 surface treatments with main step 4 siloxane polymerizations will dictate final performance attributes. Due to the stringent surface property requirements needed to achieve highly crosslinked siloxane chemical adhesion atop metal surfaces, highly controlled surface preparations and polymerization under vacuum conditions are typically used. Most preferably, siloxane chemistries are applied using finely dispersed droplets rather than ionization in a vacuum. Control and dispersion of these droplets via an airless spray atomization minimizes exposure with air from conventional paint spraying methods and achieves a preferred breakdown of siloxane dispersions in the solvent. The end result is a thin, highly transparent, "orange peel"-free durable coating.

Referring now to FIGS. 2*a* and 2*b*, there is shown two side view schematics comparing the deposits of a conventional prior art, clear coat process (FIG. 2*a*) versus the surface treatment layers deposited according to this invention (FIG. 2*b*). For vehicle wheels, the most widely used system for conversion coating is to apply powder coats using conventional acrylic or polyester chemistries. Such paint chemistries provide accessible functional groups for adhesion to the metal surface, but their adhesion strengths and durabilities are dependent on the interfacial properties of the metal alloy/conversion coat/paint system employed.

For the present invention, a diffuse interface has been postulated which minimizes the probability of coating delamination from the treated metal surface. This is achieved by replicating highly controlled surface modification processes to yield an aluminum phosphate—with the proper chemical composition, microstructure and morphology such that siloxane chemistry adhesions are accomplished at ambient pressure. The preferred siloxane based chemicals described above also result in a coating thickness approximately one order of magnitude smaller than those deposited using acrylic or polyester powders. It is believed that these carefully selected and preferably customized chemistries result in a coating with higher uniformity and transparency (i.e. optical clarity) than was possible before. In terms of hydrophobicity and permeability, siloxane based chemistries also yield more water repellent properties and lower water permeability than their acrylic and polyester coating counterparts. This results in an easier to clean (possibly even soil and debris repellant), durable (especially with respect to the absence of filiform corrosion) aluminum coated surface, in various product forms, that is both brighter and scratch/abrasion resistant than its untreated equivalents.

This method is believed to enhance Al wheel product appearance and performance for several reasons:

a. Surface Chemical Reactivity vs. Alloy Microstructure

Iron <0.15%: Keeping iron concentrations low in these alloy products helps avoid forming aluminum-iron-silicon particles. Mg and Si concentrations should be kept stoichiometrically balanced for the preferred formation of $Mg_2Si$ particles over Al-Fe-Si particles.

Particle distribution: Once alloy compositions are optimized, preferred thermomechanical steps produce desired particle and size distribution characteristics. For any Al-Fe-Si particles that form, these thermomechanical processing steps are believed to induce enough physical breakdown as to avoid continuous and preferentially oriented stringers of iron containing phases, e.g. $Al_{9\text{-}12}FeSi_x$. Without such orientations, subsequent chemical processing induces a uniform chemical reaction with the aluminum substrate. Resulting optical properties then uniformly distribute yielding a more uniform surface appearance across the entire wheel product. Where clusters or stringers may be present, the resulting surface appearance replicates an underlying precipitate pattern. For castings, solidification rates may be adjusted for minimizing grain size and the formation of dendritic structures.

Preferably, these thermomechanical processing steps achieve an average $Mg_2Si$ particle diameter of 10 mm+/−2 (100 Å+/−20) and average density smaller than 420,000 particles/$mm^2$. Both parameters are measured with an image analyzer on a metallographically polished sample of Al wheel product. When either or both parameters exceed these specified limits, microstructures react with chemical brightening electrolyte in such a way that microetching takes place and incoming light scatters from the surface giving rise to a non-uniform appearance.

$Mg_2Si$ formation vs. $Al_{9\text{-}12}FeSi_x$: These two precipitates play distinctively different roles in the final appearance of a treated Al wheel product according to the invention. Their formation mechanisms are interdependent, however, as explained earlier above. The role of $Mg_2Si$, on a microscopic level, typically manifests itself as microetching and pitting after chemical brightening and during exposure to ambient conditions upon transfer to rinsing operations or stages. Compounds containing Al-Fe-Si (e.r. $Al_{9\text{-}12}FeSi_x$), on the other hand, give rise to larger surface pits and partially detached, particle defects that originate during chemical brightening.

Cu: Precipitation of $Al_2Cu$ particles is not desirable since they become local cathodes during chemical brightening and anodizing. As a result, copper concentrations in these alloy products should be maintained at or below 0.35 wt. % to ensure solid solubility and avoid recombination with other elemental components. Copper, in solid solution, should also be kept below the specified limit to avoid widening the localized electrochemical potential gap between aluminum matrix and second phase intermetallics.

b. Chemical Reactivity as Function of Nitric Acid Concentration in Chemical Brightening Electrolite.

Once metal microstructures are optimized, subsequent processing should keep nitric acid concentrations in the chemical brightening electrolyte between about 1.2–2.2%. Typical chemical brightening of Al alloys utilize electrolytes with nitric acid concentrations greater than about 3% to induce surface passivation and avoid microetching during transfer to a rinsing operation. This is especially true for commonly used 5xxx and 6xxx series alloys whose structural properties are inferior to those of the present invention and which contain lower concentrations of solute elements. As a result, the presence of microstructural phases, as described above, are not prevalent.

For higher strength systems containing higher sizes and densities of second phase intermetallic compounds, there are no known procedures for obtaining a surface absent macro and micro defects. The present invention identifies conditions for achieving high brightness and smoothness on alloys containing such intermetallic compounds. In particular, nitric acid concentrations maintained below about 2.7% avoid in-situ reactions with Al-Fe-Si phases and the microetching of $Mg_2Si$ during transfer to a rinsing step. A preferred operating range of nitric acid is from 1.2% to 2.2%. Values exceeding these limits induce excessive reactivity with the underlying aluminum product resulting in surface and other defects. This response is opposite to normal chemical brightening practices in which higher values of nitric acid are used to minimize etching. However, most conventional applications make use of lower strength, Al alloys with microstructures that do not contain the same type and density of second phase intermetallics as per this invention.

Deoxidizing to leave <0.3% copper on surface: After Al wheel products are chemically brightened, the surface contains an adsorbed copper residue which, if not removed, could negatively affect subsequent chemical processing and finished product properties. Therefore, the surface concentration of copper needs to be reduced to a value less than about 0.3 atom% (measured with X-Ray Photoelectron Spectroscopy (or "XPS") in the outermost 75 Å of surface). Values greater than 0.3 atom% negatively impact on subsequent coating adhesion. Also, overall product durability may be compromised due to reduced corrosion resistance at the metal/coating interface leading to coating delamination, blistering and filiform corrosion. If concentrations of copper at the surface are significantly higher than these preferred values, particles give rise to light scattering resulting in reduced brightness.

c. Light Scattering as a Function of Micro-reactivity of the Metal

Visible light vs. defect size and spacing: One of the objectives in optimizing metal microstructure and chemical processing conditions, described in sections (a) and (b) above, is to achieve surface uniformity with high brightness and the absence of light scattering. In cases where some light scattering takes place, the macro and micro defects generated by the interaction between microstructure and chemical processing fall in a size and size distribution where the wavelength of visible light causes interference fringes. The resulting light scattering then manifests itself as either reduced reflectivity "Rs", reduced distinctiveness of reflected image "D/I" and/or haze "Rh", the latter two parameters being measured at 0.3° and 15° from specularity, respectively.

Assuming a product surface comprises the X-Y plane, the presence of macro or micro defects in that plane interact with the incoming light. A defect free surface, i.e, one microscopically absent of irregularities, reflects light evenly so the resulting Rs, D/I and Rh values are each 100%. On the other hand, a surface with micro defects in the X-Y plane distorts the amount of reflected light leading to reduced values of Rs, D/I and Rh.

When light distortions evenly distribute throughout the X-Y plane, the resulting appearance is still uniform even though actual values of Rs, D/I and Rh may be lower than 100%. On the other hand, when such distortions are uneven, such as preferentially located in certain surface regions (e.g. clusters of intermetallics, stringers or grain boundaries), the product appearance exhibits macro and micro irregularities in the form of patterns and regions of different luminosity. The present invention manages this local interaction of surface defects with incoming light by specifying the size and distribution of second phase particles. Therefore, through this invention, the second phase precipitates on metal microstructures should be less than 10 nm and the density less than 420,000 particles/$mm^2$ in order to avoid surface micro defects leading to uneven light reflectance and scattering. These values were found to be optimum since, upon chemical processing, the size of these microdefects on finished product surfaces end up being larger than the original size of second phase precipitate on the Al microstructure.

d. Oxide Modification for Chemical Bonding:

Oxide/Phosphate formation: The preceding chemical brightening operation is believed to prepare the product surface for oxide modification. In this invention, oxide modification is achieved by an electrochemical oxide conversion of Al product in an acid electrolyte. The specified electrolyte composition and electrochemical parameters were optimized as follows:

Surface modification is achieved by an electrochemical conversion in an acid electrolyte leading to the formation of an aluminum oxide/aluminum phosphate mixture. As a result, the interaction of modified aluminum substrate with unreacted siloxane leads to a condensation reaction which, in turn, leads to chemical bonding between oxide/phosphate layer and siloxane. Consequently, the electrochemical conversion layer behaves as the chemical interface between the aluminum product and inorganic polymer—siloxane coating. The resulting adhesion strength of this interface is believed to rely on chemical bonding rather than a physical adsorption of conventional anodized coatings (e.g. alumilite).

An electrochemical conversion in phosphoric acid leads to the formation of extremely thin films compared to conventional applications based on the same acid or other acids such as sulfuric acid (of the prior art alumilite coatings). The microstructure of this thin film comprises parallel nodules growing in a Z direction and, due to the uniformity of underlying metal, they evenly distribute in the X-Y plane resulting in the elimination of light scattering in localized areas.

e. Oxide Microstructure vs. Thickness to Avoid Light Diffraction

With reference the X-Y plane of an Al product surface, interference to the reflection of incoming light is believed to be due to such light encountering the micro defects originating at the microstructural metallurgical features (i.e. second phase precipitates and intermetallics). Assuming the size and distribution of these precipitates remains constant, the oxide/phosphate film present atop the metal yields a uniform light scatter in all directions except the Z direction perpendicular to the X-Y plane. In that Z direction, light is diffracted by the oxide/phosphate film due to its semi transparent nature which, itself, is dictated by its nodular microstructure.

The extent of light diffraction in the Z direction depends on the wavelength of incoming light and thickness of the oxide/phosphate film. The visible light wavelength spectrum ranges from 400 to 700 nm (4000 to 7000 Å, respectively). In order to avoid interference fringes within the visible light spectrum, this invention identifies an optimum oxide/phosphate thickness range less than 100 nm (1000 Å). Due to an interdependence between diffraction in the Z direction and light scattering in the X-Y plane, the preferred thickness range to obtain bright and uniform surface appearance on the finished product is between about 7.5–20 nm (75–200 Å).

f. Siloxane Chemistry Versus Oxide Chemistry

The interaction of oxide/phosphate chemistry with an inorganic polymer composed of siloxane is critical to achieve chemical bonding. In the presence of aggressive chemical environments, such as those containing chlorinated water, this mechanism eliminates the availability of sites for moisture and/or chloride ions to nucleate. As a result, the chemical bond remains intact and the corrosion resistance of the coated product is superior. This chemical bond reaction is achieved in a single process step by applying a single layer of siloxane atop this modified Al substrate, thus further illustrating that the bonding mechanism is not based strictly on physical or mechanical adsorption.

By contrast, the prior art practice in U.S. Pat. No. 5,290,424 relies on the presence of two layers, the first layer consisting of a thermoplastic vinyl polymer to achieve physical interlocking with the substrate followed by a second layer consisting of fluoropolymer to achieve the desired surface characteristics. Due to the chemical structure of those fluoropolymers, the presence of an intermediate thermoplastic layer was critical therein for obtaining attachment to the flexible Al substrate of the prior art.

Siloxane provides various surface properties: smoothness; scratch and abrasion resistance; optical clarity; impermeability to dissolved halides and metallic cations; and a non-polar surface for repelling soil and debris (similar to glass). These desired properties differ from the more flexible, resilient characteristics of the prior art's double layered vinyl/fluoropolymer coating structure.

Experimental Results

Using three different standards of corrosion performance, those established by General Motors, Ford, and ASTM Standard G85, the particulars of which are all fully incorporated by reference, aluminum wheel products treated according to this invention fared favorably well compared to a second wheel (same alloy composition) treated per the known, prior art 12-step process described above.

| Process | GM 9682P | FORD FLTM B1 124-01 | ASTM G85 |
|---|---|---|---|
| 12 Step | 2.0–2.5 mm | 2.0–3.0 nm | 3.0 mm (2 wks) |
| Invention | 0 min | 0 mm | 0 min |

Heavy duty vehicle wheels experimentally treated by the method of this invention were subjected to standard road conditions through several seasons, and to coarser, off-road, construction type conditions. In both cases, these wheels were periodically cleaned (approximately monthly) using pressurized water sprays, with and without soaps, to reveal, repeatedly, the shiny, transparent and still dirt resisting aluminum surfaces underneath.

Having described the presently preferred embodiments, it is to be understood that the invention may be otherwise embodied by the scope of the appended claims.

What is claimed is:

1. A method for surface treating an aluminum wheel product to improve its brightness, said method comprising the main steps of:

(a) applying a chemical brightening composition to the product;

(b) deoxidizing the product surface in a nitric acid-based bath;

(c) electrochemically forming a porous oxide/phosphate on said product surface by contacting with an electrolytic bath containing phosphoric acid, said oxide/phosphate being less than about 500 angstroms thick; and (d) chemically bonding a siloxane-based outer layer to the porous oxide/phosphate.

2. The method of claim 1 wherein said aluminum wheel product is made from a 5000 or 6000 Series aluminum alloy (Aluminum Association designation).

3. The method of claim 2 wherein said aluminum alloy is a 5000 Series alloy selected from the group consisting of: 5454, 5182 and 5052 aluminum.

4. The method of claim 2 wherein said aluminum alloy is a 6000 Series alloy selected from the group consisting of: 6061, 6063 and 6005 aluminum.

5. The method of claim 4 wherein said alloy contains less than about 0.35 wt. % iron.

6. The method of claim 5 wherein said alloy contains less than about 0.15 wt. % iron.

7. The method of claim 1 wherein said aluminum wheel product is forged or cast.

8. The method of claim 1 wherein said aluminum product is subjected to cleaning and rinsing prior to step (a).

9. The method of claim 8 wherein said pre-step (a) cleaning is alkaline-based.

10. The method of claim 8 wherein said pre-step (a) cleaning is acid-based.

11. The method of claim 1 wherein said aluminum wheel product is subjected to a rinsing substep after one or more of steps (a), (b) or (c).

12. The method of claim 1 wherein the chemical brightening composition of step (a) includes: about 2.7 wt % or less nitric acid, about 70–90 wt % phosphoric acid, the balance water and impurities.

13. The method of claim 12 wherein said chemical brightening composition contains about 1.2–2.2 wt % nitric acid.

14. The method of claim 1 wherein said oxide/phosphate forming step (c) includes contacting the product with an electrolytic bath containing about 2 to 15 vol % phosphoric acid.

15. The method of claim 1 wherein said oxide/phosphate is between about 75 and 200 angstroms thick.

16. The method of claim 1 wherein said siloxane-based outer layer is applied by spray coating.

17. The method of claim 1 wherein said aluminum wheel product is subjected to air drying after step (d).

18. The method of claim 17 wherein said siloxane-based film is thermally cured after air drying.

19. A method for surface treating aluminum wheel products to improve their brightness and abrasion resistance, said method comprising the steps of:

(a) applying a chemical brightening composition to said wheel products;

(b) deoxidizing the surface of said wheel products in a nitric acid-based bath;

(c) electrochemically forming a porous oxide/phosphate on said surface by contacting with an electrolytic bath containing phosphoric acid, said oxide/phosphate being less than about 500 angstroms thick;

(d) chemically bonding a siloxane-based film to the porous oxide/phosphate; and (e) thermally curing the siloxane-based film on said surface.

20. The method of claim 19 wherein said wheel products are made from a 5000 or 6000 Series aluminum alloy (Aluminum Association designation).

21. The method of claim 19 wherein said aluminum alloy is a 5000 Series alloy selected from the group consisting of: 5454, 5182 and 5052 aluminum.

22. The method of claim 21 wherein said oxide/phosphate forming step (c) includes contacting said wheel products with an electrolyte containing about 2 to 15 vol % phosphoric acid.

23. The method of claim 20 wherein said aluminum alloy is a 6000 Series alloy selected from the group consisting of: 6061, 6063 and 6005 aluminum.

24. The method of claim 20 wherein said aluminum alloy contains less than about 0.35 wt. % iron.

25. The method of claim 24 wherein said aluminum alloy contains less than about 0.15 wt. % iron.

26. The method of claim 19 wherein said wheel products are subjected to cleaning and rinsing prior to step (a).

27. The method of claim 26 wherein said pre-step (a) cleaning is alkaline-based.

28. The method of claim 26 wherein said pre-step (a) cleaning is acid-based.

29. The method of claim 19 wherein said wheel products are subjected to a rinsing substep after one or more of steps (a), (b) or (c).

30. The method of claim 19 wherein the chemical brightening composition of step (a) includes: about 2.7 wt % or less nitric acid, about 70–90 wt % phosphoric acid, the balance water and impurities.

31. The method of claim 30 wherein said chemical brightening composition contains about 1.2–2.2 wt % nitric acid.

32. The method of claim 19 wherein said oxide/phosphate is between about 75 and 200 angstroms thick.

33. The method of claim 19 wherein said siloxane-based film is applied by spray coating.

34. A method for surface treating cleaned and rinsed, 6000 Series aluminum wheel products to improve their brightness, soil and abrasion resistance, said method comprising the steps of:

(a) chemically brightening said wheel products with a composition that includes phosphoric acid and nitric acid;

(b) rinsing said wheel products;

(c) deoxidizing the surface of said wheel products in a nitric acid-based bath;

(d) rinsing said wheel products;

(e) electrochemically forming a porous oxide/phosphate on said surface by contacting with an electrolytic bath containing phosphoric acid, said oxide/phosphate being less than about 500 angstroms thick;

(f) rinsing said wheel products;

(g) chemically bonding a siloxane-based film to said oxide/phosphate; and (h) thermally curing the siloxane-based film on said wheel products.

35. The method of claim 34 wherein said 6000 Series aluminum is selected from the group consisting of: 6061, 6063 and 6005 alloys.

36. The method of claim 35 wherein said alloy contains less than about 0.35 wt. % iron.

37. The method of claim 36 wherein said alloy contains less than about 0.15 wt. % iron.

38. The method of claim 35 wherein said oxide/phosphate forming step (e) includes contacting said wheel products with an electrolytic bath containing about 2 to 15 vol % phosphoric acid.

39. The method of claim 34 wherein the composition of step (a) includes: about 2.7 wt % or less nitric acid, about 70–90 wt % phosphoric acid, the balance water and impurities.

40. The method of claim 39 wherein said chemical brightening composition contains about 1.2–2.2 wt % nitric acid.

41. The method of claim 34 wherein said oxide/phosphate is between about 75 and 200 angstroms thick.

42. The method of claim 34 wherein said wheel products are air dried after step (g).

* * * * *

UNITED STATES PATENT AND TRADEMARK OFFICE

CERTIFICATE OF CORRECTION

PATENT NO. : 6,440,290 B1
APPLICATION NO. : 09/729567
DATED : August 27, 2002
INVENTOR(S) : Luis F. Vega et al.

It is certified that error appears in the above-identified patent and that said Letters Patent is hereby corrected as shown below:

In column 11, line 6, line 1 of claim 21, after "claim", delete "19" and insert --20--.

Signed and Sealed this

Twenty-third Day of September, 2008

JON W. DUDAS
*Director of the United States Patent and Trademark Office*